US006065654A

United States Patent [19]

Evensen

[11] Patent Number: 6,065,654

[45] Date of Patent: May 23, 2000

[54] FOOTWEAR INSERTION APPARATUS AND METHOD

[75] Inventor: Robert W. Evensen, Bountiful, Utah

[73] Assignee: RW Ski Products, Inc., West Bountiful, Utah

[21] Appl. No.: 09/042,360

[22] Filed: Mar. 13, 1998

[51] Int. Cl.[7] ..... A47G 25/80

[52] U.S. Cl. ..... 223/113; 223/112

[58] Field of Search ..... 223/112, 111, 223/113, 118

[56] References Cited

U.S. PATENT DOCUMENTS

| | | | |
|---|---|---|---|
| 4,467,073 | 8/1984 | Creasy | 525/127 |
| 4,642,267 | 2/1987 | Creasy | 428/413 |
| 4,991,757 | 2/1991 | Deakyne | 223/112 |
| 5,601,220 | 2/1997 | Vossen | 223/112 |
| 5,662,960 | 9/1997 | Hostettler et al. | 427/2.3 |
| 5,706,988 | 1/1998 | Moore | 223/111 |
| 5,741,569 | 4/1998 | Votino et al. | 223/111 |

*Primary Examiner*—Bibhu Mohanty
*Attorney, Agent, or Firm*—Foster & Foster

[57] ABSTRACT

A footwear insertion apparatus includes a flexible, moldable sheet of material having a layer of hydrophilic or lubricious material disposed on at least one side of the flexible sheet of material. The hydrophilic or lubricious material preferably becomes highly slippery when in contact with water. The footwear insertion apparatus is configured to be readily inserted into the opening of a unit of footwear to interface between a person's foot and the unit of footwear while the person's foot is being inserted into the footwear. The insertion apparatus may include a handle to facilitating grasping of the insertion apparatus for installation and removal purposes. The insertion apparatus may also include a float to suspend the insertion apparatus when placed in water.

37 Claims, 4 Drawing Sheets

FOOTWEAR INSERTION APPARATUS AND METHOD

TECHNICAL FIELD

This invention relates footwear, and more particularly to devices and methods for assisting in the insertion of a foot into a unit of footwear.

BACKGROUND OF THE INVENTION

It has long been a problem for wearers of tight-fitting footwear to effectively place their feet inside such footwear. Traditional shoe horns have served over the course of many years to facilitate insertion of a foot into footwear. While a traditional shoe horn may be sufficient in certain circumstances, it becomes highly ineffective and impractical in others.

In addition to the needs associated with placing a person's foot inside of traditional footwear, a particular need exists to facilitate the insertion of a person's foot into a type of tight-fitting, high-performance footwear. Examples include, without limitation, water ski boots, wake board boots, snow skiing boots, snowboard boots, mountaineering boots, diving footwear, diving fins, and any other conceivable high-performance footwear. Given the external forces associated with the activities requiring such high-performance footwear, an extremely tight fit between the person's foot and the footwear is often required. Certain binding systems may allow the footwear to be secured tightly around the person's foot subsequent to entry into the footwear. On the other hand, certain footwear is not intended to be secured in an after-the-fact manner about the user's foot. Rather, the person's foot must be inserted into the footwear in the tight-fitting position where the footwear will ultimately remain during use of the performance footwear.

In the particular example of water ski boots, a person is typically required to insert his or her foot into the water ski boot while in the water. This can be cumbersome and awkward, yet the fit between the person's foot and the water ski boot must remain extremely tight. In addition, there are problems associated with utilizing any type of device where the device is difficult to use or may be lost in the water.

One traditional way that person's have attempted to resolve the problem specifically relating to footwear for water sports is to use a particular type of gel or lubricious substance. Typically, the lubricious substance is smeared over the person's foot and, subsequently, the person's foot is inserted into the footwear. Problems associated with these prior methods are apparent. First, the application of such a lubricious material while a person is floating in water attempting to insert his or her foot inside a water ski boot can be extremely difficult, at best. In addition, the potential for the residue to harm the environment exists. Still further, some of the lubricious material will necessarily remain between the person's foot and the high-performance footwear for some period of time.

In view of the foregoing, there has remained a need to facilitate insertion of a person's foot into high-performance footwear of all types, particularly footwear for water sports. This need is particularly great where the high-performance footwear is intended to be used in a wet or potentially wet environment, such as water, snow, and the like. In particular, a tight fit is required for water skiing, wake boarding, and other similar water sports given the forces exerted upon the equipment during normal use. Where such a tight fit is necessary, the interference between a person's foot and the footwear that must be overcome is significant. Often it is not possible to get the proper tight fit without some type of external assistance.

In view of the foregoing, there is a need to provide a reliable, easy-to-use system for facilitating insertion of a person's foot into high-performance footwear. A particular need exists with respect to footwear for water sports.

SUMMARY AND OBJECTS OF THE INVENTION

It is an object of the invention to provide a device for facilitating the insertion of a person's foot into high-performance footwear.

Another object of the invention is to provide a device that enables a person's foot to be more easily inserted into footwear utilized for water sports where a particularly tight fit is required.

Another object of the invention is to provide a footwear insertion device that is hydrophilic in nature and becomes slippery when wet to enable a person's foot to be easily inserted into tight-fitting footwear, including footwear intended for use in connection with water sports.

Yet another object of the present invention is to provide a footwear insertion apparatus that is easy to use to assist in the insertion of a foot into footwear for water sports when the person using the apparatus is floating in water.

Still another object of the invention is to provide a footwear insertion apparatus that can be placed inside of and removed from the footwear with relative ease.

Still another object of the invention is to provide a footwear insertion apparatus that will float so that the apparatus does not sink when placed in water.

Yet another object of the invention is to provide a footwear insertion apparatus that includes a coating of hydrophilic material, such as a hydrophilic polymer blend, which becomes slippery when in contact with water to facilitate insertion of one's foot into high performance footwear, yet leaves no significant or appreciable residue on the person's foot after the apparatus has been used.

The foregoing objects are achieved by a footwear insertion apparatus according to the present invention. The footwear entry system comprises a sheet of moldable, flexible material having a thickness and a periphery. The sheet of material is coated on at least one side with a layer of a hydrophilic material which becomes highly slippery when in contact with water. The sheet of material is configured to be easily inserted inside a unit of footwear, and thereafter will facilitate insertion of a person's foot into the footwear, even where the footwear is extremely tight-fitting. The sheet of material may thereafter be removed with ease and will leave the foot free of any significant or appreciable residue, yet held within the confines of a tight-fitting, high-performance type of footwear.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
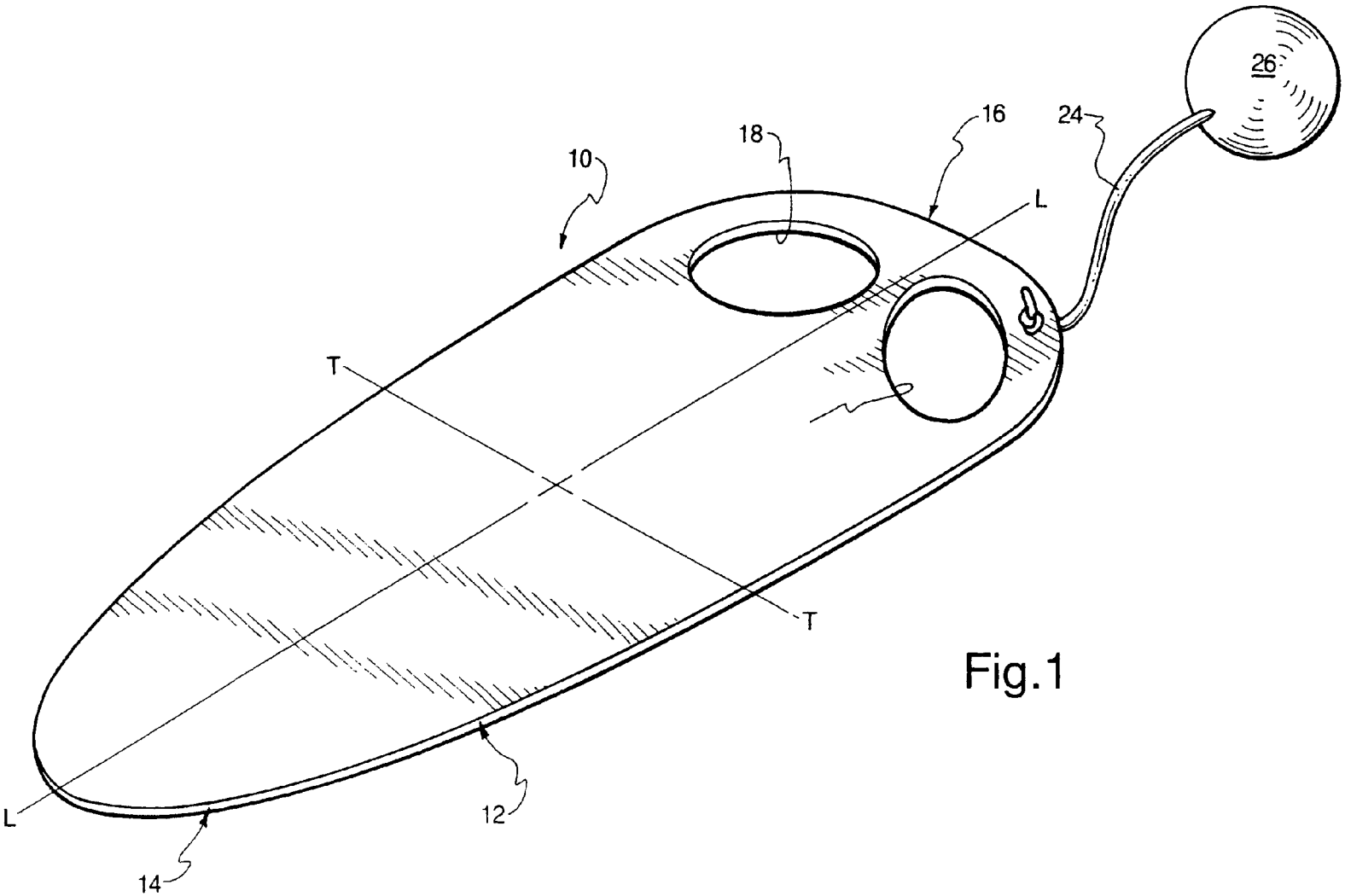
FIG. 1 is a perspective view of a footwear insertion apparatus according to the present invention.
Figure 3:
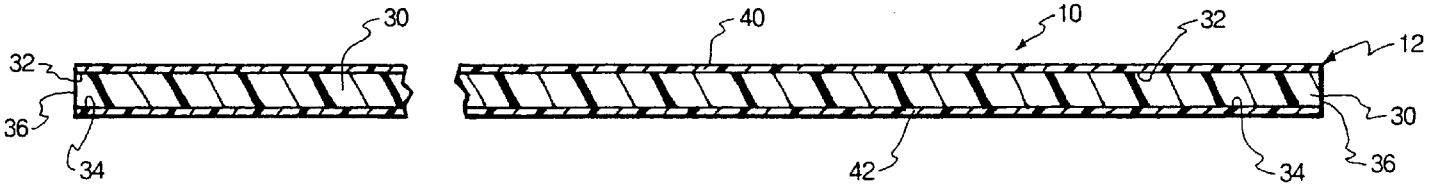
FIG. 3 is a sectional view, taken along the line 3—3 of FIG. 2, of the footwear insertion apparatus of FIG. 1.
Figure 2:
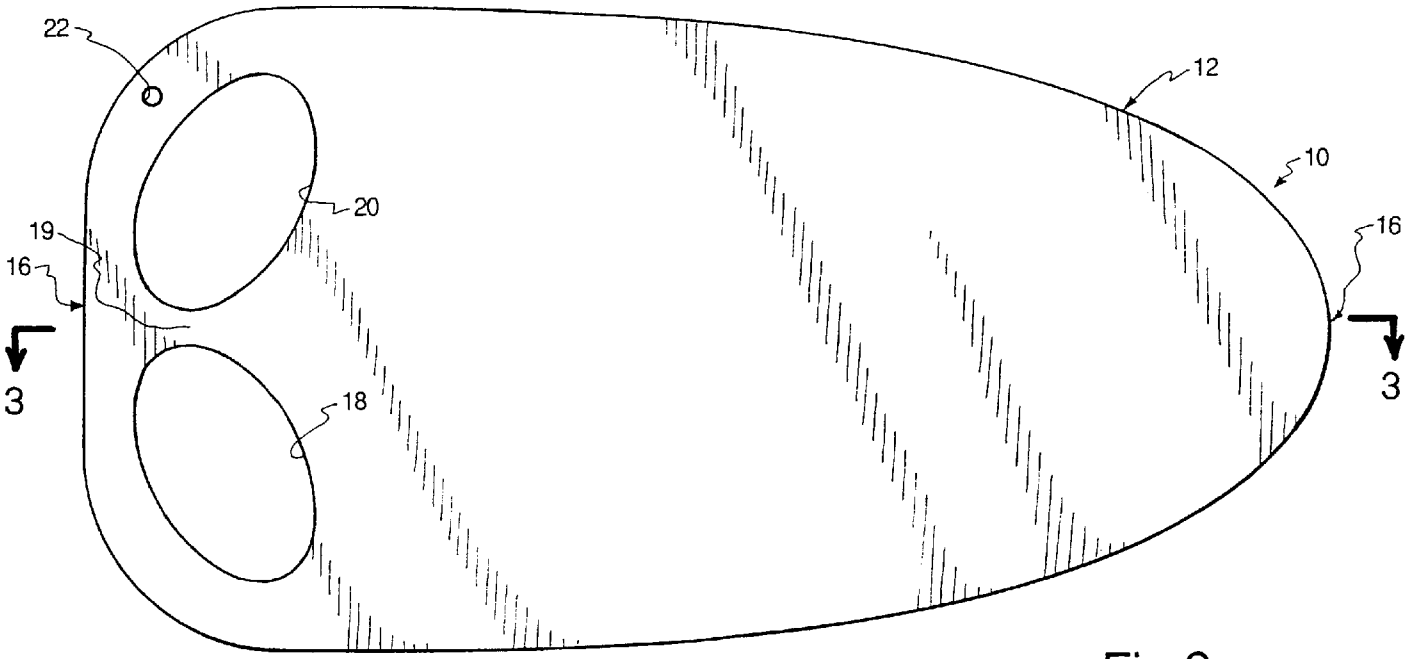
FIG. 2 is a top, plan view of the footwear insertion apparatus of FIG. 1.

FIGS. 1–3 show a footwear insertion apparatus 10 according to the present invention. The footwear insertion apparatus generally comprises a flexible, moldable sheet of material 12. The sheet of material has a longitudinal axis L and a transverse axis T which runs perpendicular to the longitudinal axis L. The flexible, moldable sheet of material 12 is formable and bendable simultaneously in multiple directions, including about the longitudinal axis L and the transverse axis T. The primary or base material utilized for the flexible, moldable sheet of material is preferably made of polyurethane, but could be made of any suitable material provided that the moldable, flexible characteristics, as well as suitable bonding characteristics (discussed below) are present.

The thin, flexible sheet of material 12 comprises a bottom end 14 and a top end 16. The top end 16 is relatively wider than the bottom end 14. The periphery of the sheet of flexible, moldable material 12 tapers from the top end 16 to the bottom end 14. The configuration of the insertion apparatus 10 allows the apparatus to be readily placed inside a unit of footwear.

With continuing reference to FIGS. 1–3, the footwear insertion apparatus further comprises a pair of apertures 18, 20 formed in the sheet of material toward the top end 16. A small strip 19 of the sheet of material 12 separates the apertures 18, 20. The apertures are generally elliptical in shape and converge at one end toward the longitudinal axis L of the sheet of flexible, moldable material 12. The apertures serve as a handle and allow a person to grasp the flexible, moldable sheet of material. Through use of the apertures 18, 20, a person can more readily install the footwear insertion apparatus into a unit of footwear and subsequently remove the sheet of flexible material from the unit of footwear after a person's foot has been inserted into the unit of footwear. This process will be described in greater detail below.

The footwear insertion apparatus 10 further comprises a tether aperture 22 (FIG. 2) to which a tether 24 can be inserted to secure, in turn, a float 26. The tether can be attached to the sheet of material and float, respectively, by any suitable means. FIG. 1 shows the tether knotted at the end that has been inserted through aperture 22 of the apparatus 10. The tether likewise may be made of any suitable material, such as rubber.

The float 26 may be made of any suitable material which has sufficient size and buoyancy characteristics to be visible above the surface of a body of water to suspend the flexible sheet of material 12 when placed in water. For example, the float 26 may be made of styrofoam and may or may not be coated with any desirable protective outer layer. The float may be made of any desired size and shape.

As shown in FIG. 3, the flexible, moldable sheet of material 12 more specifically comprises a substrate 30 having a first side 32, a second side 34, and a periphery 36. The substrate must have appropriate bonding characteristics to ensure a proper bond between the substrate and the hydrophilic layer of material. One suitable material that may be used as a substrate is polyurethane.

A first layer of hydrophilic material 40 is disposed on the first or top side 32 of the flexible material or substrate 30. A second layer of hydrophilic material may be disposed on the second side of the flexible sheet of material or substrate 30. Any suitable process may be used for coating the substrate with the hydrophilic material. Dipping or spraying processes may be used. The hydrophilic material should have sufficient time to dry and cure according to the materials used.

The hydrophilic material may be of any substance that is slippery to the touch. By way of example only, substances described in U.S. Pat. No. 5,662,960 and U.S. Pat. No. 4,642,267 may be utilized as the hydrophilic material of the present invention. These patents are incorporated in their entirety into the present patent application by reference.

Preferably, the hydrophilic material will be slippery to the touch of a portion of the human body. This substance may be lubricious with or without the addition of water. The above-mentioned patents disclose suitable hydrophilic-type substances that become more slippery when in contact with water. Thus, in a preferred embodiment, wetting the hydrophilic material with water will cause the hydrophilic material to become more slippery to the touch and further enhance the usefulness of the insertion apparatus. It is to be understood, however, that it would not be departing from the scope of the present invention to utilize another type of lubricious material provided it results in a relatively low coefficient of friction between a portion of the human body and the particular material being used.

The lubricious or hydrophilic material utilized with the present invention will preferably leave no significant or appreciable residue on the person after it comes into contact with a portion of the human body. A primary benefit associated with the present invention is that it facilitates the insertion of a person's foot into extremely tight-fitting footwear and the facilitating device is completely removed from the footwear. This is in contrast to some of the prior-known lubricants that are spread all over a person's foot prior to insertion into the footwear. Portions of these lubricants necessarily remain between the foot and the footwear for an indefinite period of time.

Figure 4:
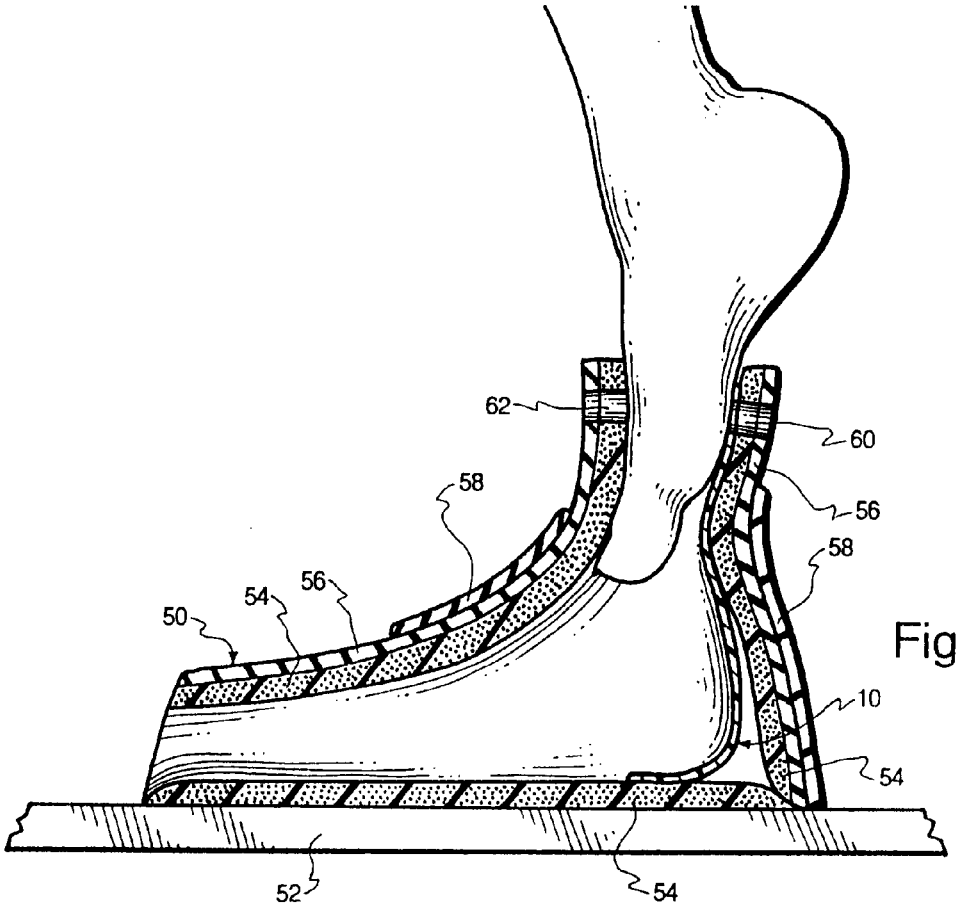
FIG. 4 is a first diagrammatic view, partly in section, of a foot being inserted into a unit of footwear utilizing the footwear insertion apparatus of FIG. 1.
Figure 5:
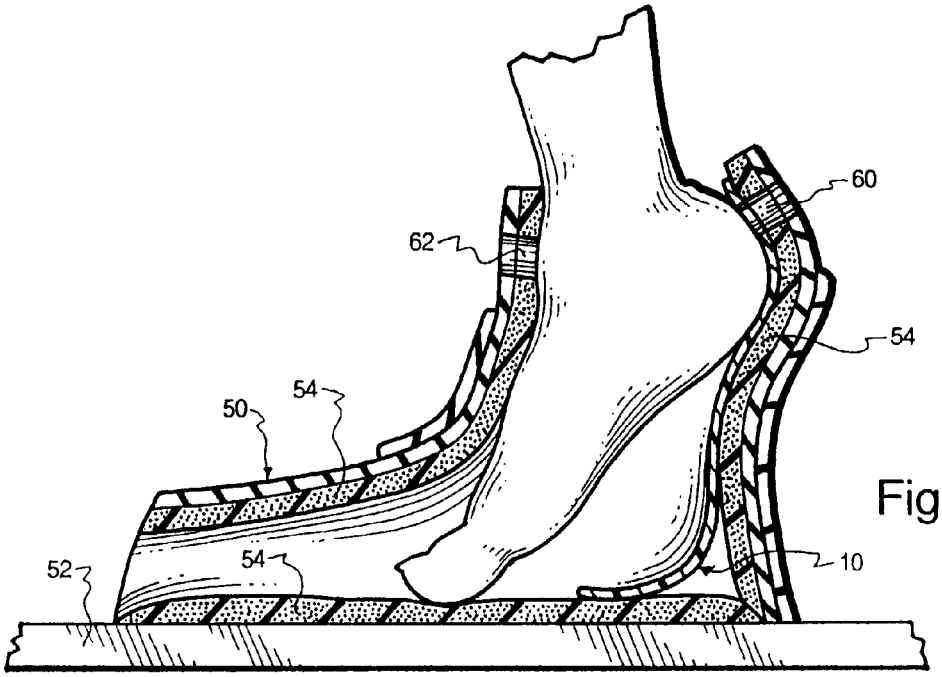
FIG. 5 is a second diagrammatic view, partly in section, of a foot being inserted into a unit of footwear utilizing the footwear insertion apparatus of FIG. 1.

FIGS. 4–7 show a series of diagrammatic views with respect to the method of insertion of a person's foot into a unit of footwear according to the present invention. As shown in FIG. 4, the footwear insertion apparatus 10 is first placed inside a particular unit of footwear 50. It is to be understood that this type of footwear shown in the drawings is merely representative of one of any number of different types of footwear, particularly high-performance footwear.

The specific unit of footwear 50 shown in FIGS. 4–7 is a water ski boot secured to a water ski 52. The water ski boot includes an inner layer of conventional foam material 54 and a relatively harder, protective outer layer 56 which covers the moldable inner foam material 54. A binding system of some type 58 serves to additionally hold a person's foot inside the boot 50. It is to be understood that the inside foam, the outer protective shell 56 and the binding system 58 are conventional.

The present invention can be utilized in connection with virtually any type of high-performance footwear. Some examples, without limitation, include water ski boots, wake board boots, snowboard boots, mountaineering boots, water sports boots, and any other type of high-performance footwear that requires a particularly tight fit between the person's foot and the footwear. The invention is particularly suitable for footwear utilized in connection with water sports. The hydrophilic properties of the coating of material 40, 42 (FIG. 3) enhance the slipperiness or lubriciousness of the material when immersed in water. Thus, the footwear insertion apparatus highly suitable for use in connection with footwear for water sports where the footwear is to be installed and removed around water.

Turning again to the method of insertion shown in FIGS. 4–7, the footwear insertion apparatus 10 is inserted into the unit of footwear 50 such that the insertion apparatus 10 acts as an interface between portions of the inside surface of the footwear (i.e., the foam 54) and the person's foot.

As shown in FIG. 4, a highly restricted opening in the footwear enables only the toes of a person's foot to be first inserted into the footwear 50. The bottom portion of a person's foot will come in contact with the insertion apparatus 10. As the foot is further inserted into the footwear 50, the resistance due to the small opening in the footwear becomes greater as the person's heel engages the back wall of the footwear. The insertion apparatus 10 greatly facilitates overcoming this extreme interference fit.

As is generally understood, getting a person's heel into tight-fitting footwear can be the most difficult part of the insertion process. The heel engages the insertion apparatus 50 and slides down to rest in the proper position, shown in FIG. 6. Even as the heel passes by the apertures 18, 20 (FIGS. 1 and 2) formed in the sheet of material 12, the thin strip of material 19 continues to interface between the person's foot and the inside surface of the footwear. Thus, there is always a portion of the insertion apparatus 10 between the person's foot and the footwear.

Figure 6:
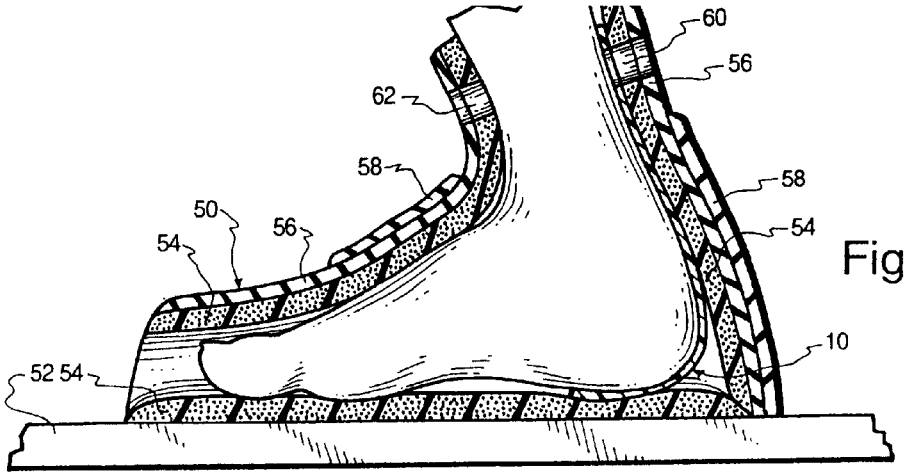
FIG. 6 is a third diagrammatic view, partly in section, of a foot being inserted into a unit of footwear utilizing the footwear insertion apparatus of FIG. 1.
Figure 7:
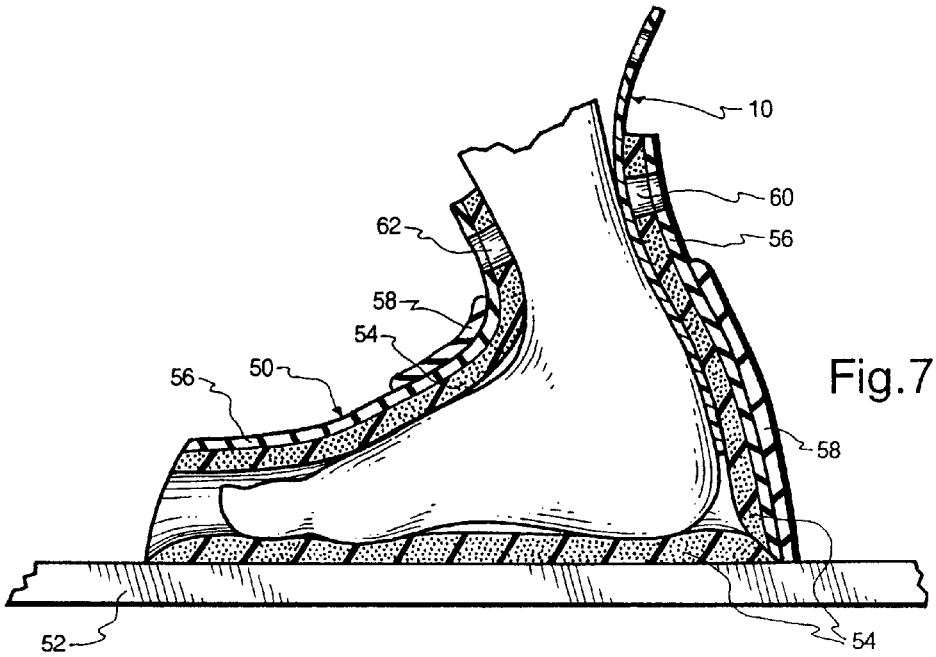
FIG. 7 is a fourth diagrammatic view, partly in section, of a foot being inserted into a unit of footwear utilizing the footwear insertion apparatus of FIG. 1.

After the person's foot has been completely inserted into the footwear (as shown in FIG. 6), the insertion apparatus 10 is easily removed from inside the footwear by grasping the handle provided by apertures 18, 20, and pulling the insertion apparatus out of the footwear. Again, the hydrophilic coating on the insertion apparatus facilitates this procedure.

It is to be understood that the flexible, moldable properties of the sheet of material 12, which forms the primary portion of the insertion apparatus 10, allow the insertion apparatus to simultaneously articulate or bend about the longitudinal axis L and transverse axis T (see FIG. 1). This allows a person's foot to be inserted into the footwear while maintaining the insertion apparatus 10 inside the footwear as well. The properties of the layers of hydrophilic material 40, 42 (FIG. 3) also allow them to bend and form in the same manner as the sheet of material 12.

A particular advantage associated with the present invention relates to the apertures 18 and 20 formed toward the top end 16 (FIGS. 1 and 2) of the insertion apparatus 10. The apertures 18, 20 are generally elliptical in shape and converge toward the upper end 16. The convergence of these two apertures allows a person to easily grasp the insertion apparatus 10 after it has been utilized to assist in the insertion of a person's foot inside of high-performance footwear. The closeness of the apertures toward the top end 16 of the insertion apparatus 10 makes the device easily and more comfortable to grasp and pull from the footwear.

Figure 8:
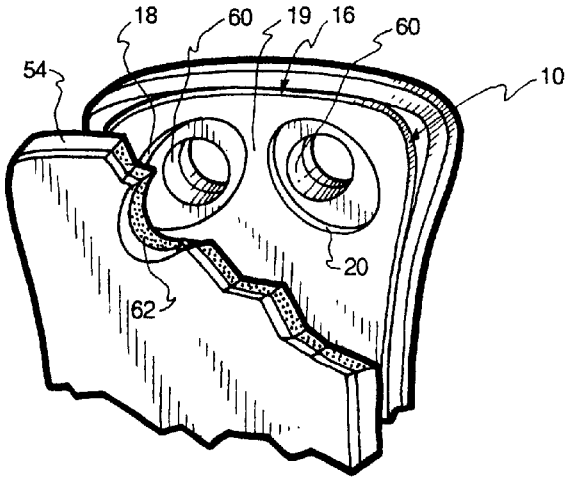
FIG. 8 is a partial perspective view, partly in section, of the footwear insertion apparatus of FIG. 1 inserted into a unit of footwear showing the apertures of the insertion apparatus aligned with conventional apertures formed in the unit of footwear.

An additional benefit of the configuration of the apertures 18, 20 is that they are large enough and specifically sized to accommodate most conventional apertures formed at the openings of high-performance footwear. In a specific example shown in the device of FIGS. 4–7, a pair of apertures 60 (both shown in FIG. 8) are formed in the back wall of the footwear 50 and a pair of apertures 62 (only one shown) are formed in the front wall of the footwear. These apertures have traditionally been provided to allow a person inserting his or her foot into the unit of footwear to grasp the footwear at its opening and separate the two sides to allow for easier insertion of the foot into the unit of footwear. The apertures 18 and 20 formed in the insertion apparatus 10 are large enough and configured appropriately to corresponding with most of the known locations of apertures in these types of footwear. Accordingly, the old and well-known method of grasping the opening of the footwear itself and prying it apart at its opening can be utilized in connection with the insertion apparatus 10 of the present invention.

The method shown in FIGS. 4–7 show the device as being utilized solely to assist the heel portion of a person's foot slide over the insertion apparatus 10 to overcome the interference fit at the neck of the footwear. It is to be understood, however, that the insertion apparatus 10 could likewise be used between the top portion of the person's foot (i.e., at the top of the arch) and the forward portion of the footwear opening. Still further, two separate insertion apparatuses 10 could be utilized simultaneously to assist in the insertion of a person's foot into extremely tight-fitting footwear. One insertion apparatus 10 would interface between the person's heel and the back portion of the footwear, and another would interface between the person's top of the foot at the arch and the forward portion of the footwear. Where the insertion apparatus 10 is utilized in connection with interfacing between the top or arch area of a person's foot and the forward portion of the footwear, the apertures 18, 20 could similarly be aligned with the forward apertures 62 formed in the forward portion of the footwear.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

I claim:

1. A water sports footwear insertion apparatus, comprising:

a sheet of flexible, moldable material, the sheet of material having a first side, a second side, a thickness, a longitudinal axis, and a periphery, the sheet of material being positionable inside footwear to facilitate entry of a person's foot into the footwear;

a first layer of hydrophilic material disposed on the first side of the sheet of material, the hydrophilic material facilitating entry of a person's foot into the footwear.

2. A water sports footwear insertion apparatus according to claim 1, further comprising a handle formed on one end of the flexible sheet of material.

3. A water sports footwear insertion apparatus according to claim 1, further comprising a handle formed on one end of the flexible sheet of material, the handle comprising an aperture sized to receive a person's finger for grasping the sheet of material.

4. A water sports footwear insertion apparatus according to claim 1, further comprising a handle formed on one end of the flexible sheet of material, the handle comprising a pair of apertures sized to receive a person's fingers for grasping the sheet of material.

5. A water sports footwear insertion apparatus according to claim 1, further comprising a handle formed on one end of the flexible sheet of material, the handle comprising a pair of apertures sized to receive a person's fingers for grasping the sheet of material, the apertures being generally elliptical in shape.

6. A water sports footwear insertion apparatus according to claim 1, further comprising a handle formed on one end of the flexible sheet of material, the handle comprising a pair of apertures sized to receive a person's fingers for grasping the sheet of material, the apertures being generally elliptical in shape and converging toward each other at the longitudinal axis of the sheet of material.

7. A water sports footwear insertion apparatus according to claim 1, further comprising:

a handle formed on one end of the flexible sheet of material, the handle comprising a pair of apertures sized to receive a person's fingers for grasping the sheet of material, the apertures being generally elliptical in shape and converging toward each other at the longitudinal axis of the sheet of material;

a strip formed in the sheet of material, the strip separating the apertures.

8. A water sports footwear insertion apparatus according to claim 1 wherein the hydrophilic material becomes more slippery when in contact with water.

9. A water sports footwear insertion apparatus according to claim 1 wherein the hydrophilic material becomes more slippery when wet yet leaves no significant residue on surfaces with which the hydrophilic material comes into contact.

10. A water sports footwear insertion apparatus according to claim 1, further comprising a second layer of hydrophilic material disposed on the second side of the sheet of material.

11. A water sports footwear insertion apparatus according to claim 1, further comprising a float attached to the sheet of material to suspend the sheet of material when placed in water.

12. A water sports footwear insertion apparatus according to claim 1, further comprising a float and a tether for attaching the float to the sheet of material.

13. A water sports footwear insertion apparatus according to claim 1 wherein the sheet of material is flexible simultaneously about the longitudinal axis and about an axis transverse to the longitudinal axis to conform to a person's foot when inserted inside the footwear.

14. A water sports footwear insertion apparatus according to claim 1 wherein the periphery of the sheet of material is tapered at one end to facilitate insertion of the sheet of material into the footwear.

15. A water sports footwear insertion apparatus, comprising:

a flexible, moldable substrate;

a film of hydrophilic material disposed on the substrate;

the substrate being of a size to enable insertion inside a unit of footwear prior to a person's foot, the substrate being moldable about a person's foot upon insertion into the footwear, the substrate remaining between the footwear and the person's foot as the foot is being inserted into the footwear to facilitate entry of the person's foot into the footwear.

16. A water sports footwear insertion apparatus according to claim 15, further comprising a handle formed on one end of the substrate.

17. A water sports footwear insertion apparatus according to claim 15, further comprising a handle formed on one end of the substrate, the handle comprising an aperture sized to receive a person's finger for grasping the substrate.

18. A water sports footwear insertion apparatus according to claim 15, further comprising a handle formed on one end of the substrate, the handle comprising a pair of apertures sized to receive a person's fingers for grasping the substrate.

19. A water sports footwear insertion apparatus according to claim 15, further comprising a handle formed on one end of the substrate, the handle comprising a pair of apertures sized to receive a person's fingers for grasping the substrate, the apertures being generally elliptical in shape.

20. A water sports footwear insertion apparatus according to claim 15, further comprising a handle formed on one end of the substrate, the handle comprising a pair of apertures sized to receive a person's fingers for grasping the substrate, the apertures being generally elliptical in shape and converging toward each other at a longitudinal axis of the substrate.

21. A water sports footwear insertion apparatus according to claim 15, further comprising:

a handle formed on one end of the substrate, the handle comprising a pair of apertures sized to receive a person's fingers for grasping the substrate, the apertures being generally elliptical in shape and converging toward each other at a longitudinal axis of the substrate;

a strip formed in the sheet of material, the strip separating the apertures.

22. A water sports footwear insertion apparatus according to claim 15 wherein the film of hydrophilic material becomes more slippery when in contact with water.

23. A water sports footwear insertion apparatus according to claim 15 wherein the film of hydrophilic material becomes more slippery when wet yet leaves no significant residue on surfaces with which the lubricious material comes into contact.

24. A water sports footwear insertion apparatus according to claim 15 wherein the substrate has a first side and a second side, the film of hydrophilic material being disposed on the first side and the second side.

25. A water sports footwear insertion apparatus according to claim 15, further comprising a float attached to the substrate to suspend the substrate when placed in water.

26. A water sports footwear insertion apparatus according to claim 15, further comprising:

a float attached to the substrate to suspend the substrate when placed in water;

a tether for attaching the float to the substrate.

27. A water sports footwear insertion apparatus according to claim 15 wherein the substrate comprises a longitudinal axis and a transverse axis, the substrate being flexible simultaneously about the longitudinal axis and about the transverse axis to conform to a person's foot when inserted inside the footwear.

28. A water sports footwear insertion apparatus according to claim 15 wherein the substrate comprises a periphery, the periphery being tapered to facilitate insertion of the substrate into the footwear.

29. A method of inserting a person's foot into a unit of footwear, comprising the steps of:

providing a footwear insertion apparatus, comprising:

a sheet of flexible, moldable material;

a layer of hydrophilic material disposed on the flexible material, the hydrophilic material becoming slippery when wet;

wetting the footwear insertion apparatus;

inserting the footwear insertion apparatus into a unit of footwear;

inserting a person's foot into the unit of footwear while maintaining the sheet of material between a portion of the person's foot and the footwear, the person's foot contacting the layer of hydrophilic material to facilitate insertion of the person's foot into the unit of footwear.

30. The method of claim 29, further comprising the steps of:

grasping the footwear insertion apparatus;

removing the footwear insertion apparatus from the footwear after the person's foot has been inserted into the footwear.

31. A water sports footwear insertion apparatus according to claim 15 where the substrate comprises a periphery, the periphery being tapered to facilitate insertion of the substrate into the footwear, the substrate being placed into the footwear such that a portion of the substrate is positioned contiguously adjacent a bottom, inside surface of the footwear.

32. The method of claim 29 wherein the step of inserting the footwear insertion apparatus into a unit of footwear comprises placing a portion of the footwear insertion apparatus contiguously adjacent a bottom surface of the unit of footwear.

33. The method of claim 29, further comprising the step of immersing the footwear insertion apparatus in water prior to placing a portion of the footwear insertion apparatus contiguously adjacent a bottom surface of the unit of footwear.

34. A water sports footwear insertion apparatus, comprising:

a flexible, moldable substrate having a first side and a second side;

a film of hydrophilic material disposed on the first side and the second side of the substrate;

the substrate being of a size to enable insertion inside a unit of water sports footwear prior to insertion of a person's foot, the substrate being positioned contiguously adjacent a bottom surface and side surfaces of the unit of water sports footwear, the substrate being moldable about a person's foot upon insertion of the foot into the unit of water sports footwear, the substrate remaining between the bottom surface and the side surfaces of the unit of water sports footwear while the person's foot is being inserted into the footwear to facilitate entry of the person's foot into the footwear.

35. A combined water sports footwear unit and a water sports footwear insertion apparatus, comprising:

a water sports footwear unit;

a sheet of flexible, moldable material, the sheet of material having a top side, a bottom side, a thickness, and a periphery, the sheet of material being positionable inside the water sports footwear unit to facilitate entry of a person's foot into the water sports footwear;

a layer of hydrophilic material disposed on at least one of the top side or the bottom side of the sheet of material, the hydrophilic material facilitating entry of a person's foot into the unit of footwear.

36. A combined water sports footwear unit and a water sports footwear insertion apparatus according to claim 35 wherein the layer of hydrophilic material is disposed on the top side and the bottom of the sheet of material, the hydrophilic material facilitating insertion of the footwear insertion apparatus into the unit of footwear and facilitating entry of a person's foot into the unit of footwear.

37. A water sports footwear insertion apparatus, comprising:

a flexible, moldable substrate, the substrate having a periphery, a top side, and a bottom side;

a layer of hydrophilic material disposed on at least one of the top side or the bottom side of the substrate;

the substrate having a narrowed, tapered forward end to facilitate insertion of the substrate into a unit of water sports footwear, the substrate having an enlarged rearward end relative to the narrowed, tapered forward end, the periphery being curved and gradually contoured from the narrowed, tapered forward end to the enlarged rearward end.

* * * * *